US010682746B2

(12) United States Patent
Su

(10) Patent No.: US 10,682,746 B2
(45) Date of Patent: Jun. 16, 2020

(54) RUBBER MALLET

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 175 days.

(21) Appl. No.: 15/632,445

(22) Filed: Jun. 26, 2017

(65) Prior Publication Data

US 2018/0036872 A1 Feb. 8, 2018

(30) Foreign Application Priority Data

Aug. 3, 2016 (TW) ..... 105124684

(51) Int. Cl.
*B25D 1/14* (2006.01)
*B25G 3/28* (2006.01)
*A63B 59/60* (2015.01)

(52) U.S. Cl.
CPC ..... *B25D 1/14* (2013.01); *A63B 59/60* (2015.10); *B25G 3/28* (2013.01); *B25D 2222/57* (2013.01); *B25D 2250/295* (2013.01)

(58) Field of Classification Search
CPC ..... B25D 1/14; B25D 2222/57; B25D 2250/295; B25D 1/00; B25D 1/04; B25D 1/02; A63B 59/60; B25G 3/28; B25F 1/00
See application file for complete search history.

(56) References Cited

U.S. PATENT DOCUMENTS 2,335,497 A * 11/1943 Ehrsam ..... B23P 15/40 30/314
2,994,353 A * 8/1961 Yearley ..... B25G 3/02 81/20
4,373,565 A * 2/1983 Soto ..... B25D 1/02 81/19
5,996,442 A * 12/1999 Carmien ..... B25D 1/02 294/53.5
2005/0022631 A1* 2/2005 Brazil ..... B25B 13/04 81/119
2006/0278051 A1* 12/2006 Gauthier ..... B25B 23/141 81/473
2008/0168629 A1* 7/2008 Touchette ..... B25D 1/14 16/430
2008/0276770 A1* 11/2008 Blum ..... B25B 15/02 81/489
2012/0266726 A1* 10/2012 Onello ..... B25D 1/14 81/20
2014/0259695 A1* 9/2014 Guynn ..... B26B 23/00 30/308.1

(Continued)

FOREIGN PATENT DOCUMENTS

CN 2378159 Y 5/2000
CN 201702755 U 1/2011

(Continued)

*Primary Examiner* — Robert J Scruggs
(74) *Attorney, Agent, or Firm* — Alan D. Kamrath; Karin L. Williams; Mayer & Williams PC

(57) ABSTRACT

A rubber mallet includes a handle and a striking head. The striking head includes an outer body and an inner body within the outer body. The outer body defines a receiving space receiving the inner body. The outer and inner bodies are made of different materials.

14 Claims, 6 Drawing Sheets

(56) References Cited

U.S. PATENT DOCUMENTS

2016/0288311 A1* 10/2016 Ferris ..... B25G 1/04

FOREIGN PATENT DOCUMENTS

| | | | |
|---|---|---|---|
| CN | 203156703 | U | 8/2013 |
| CN | 104084933 | A | 10/2014 |
| CN | 204248830 | U | 4/2015 |
| CN | 204308919 | U | 5/2015 |
| CN | 104985562 | A | 10/2015 |
| CN | 104985563 | A | 10/2015 |
| CN | 204686825 | U | 10/2015 |
| KR | 200378134 | Y1 | 3/2005 |

* cited by examiner

RUBBER MALLET

BACKGROUND OF THE INVENTION

1. Field of the Invention

The present invention relates to a rubber mallet and, particularly, to a rubber mallet including a striking head which is made economically as well as has satisfactory strength.

2. Description of the Related Art

A rubber mallet includes a striking head and a handle. The striking head is a one-piece structure and is made of rubber. The rubber mallet is commonly used in the car industry. It can hit stamped sheet parts without causing any damage to paints of the sheet parts. However, the rubber striking head substantially increases the cost of manufacture of the rubber mallet.

The present invention is, therefore, intended to obviate or at least alleviate the problems encountered in the prior art.

SUMMARY OF THE INVENTION

According to the present invention, a rubber mallet includes a handle and a striking head. The striking head includes an outer body and an inner body disposed within the outer body. The outer body defines a receiving space receiving the inner body. The outer and inner bodies are made of different materials. The outer body defines a hole. The handle inserts through the hole and has an end fixed to the inner body and another end protruding outside of the outer body and disposed outside of the hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a rubber mallet which not only has a cheaper cost of manufacture, but also has a satisfactory strength and transmits satisfactory kinetic energy.

Other objectives, advantages, and new features of the present invention will become apparent from the following detailed description of the invention when considered in conjunction with the accompanied drawings.

DETAILED DESCRIPTION OF THE INVENTION

Figure 1:
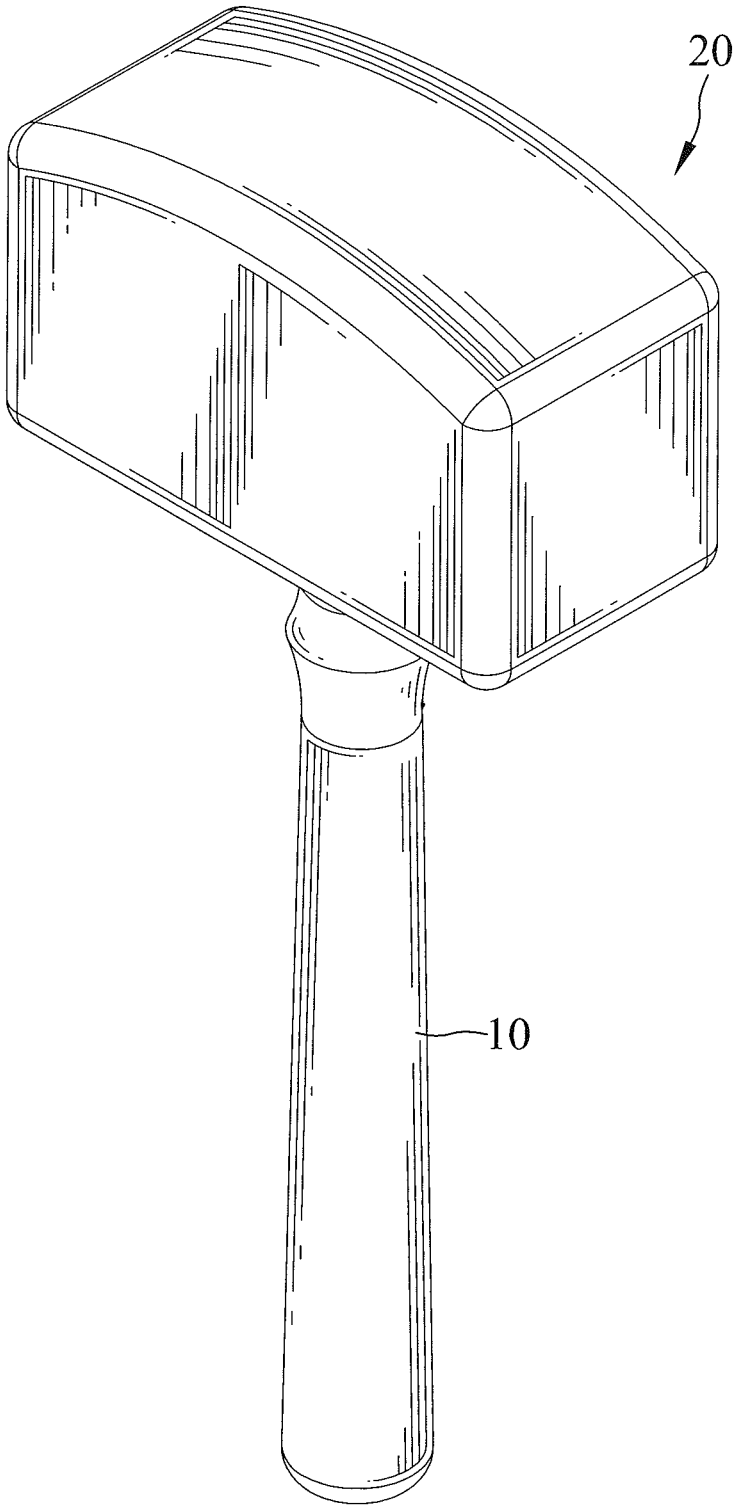
FIG. 1 is a perspective view of a rubber mallet in accordance with the present invention.
Figure 2:
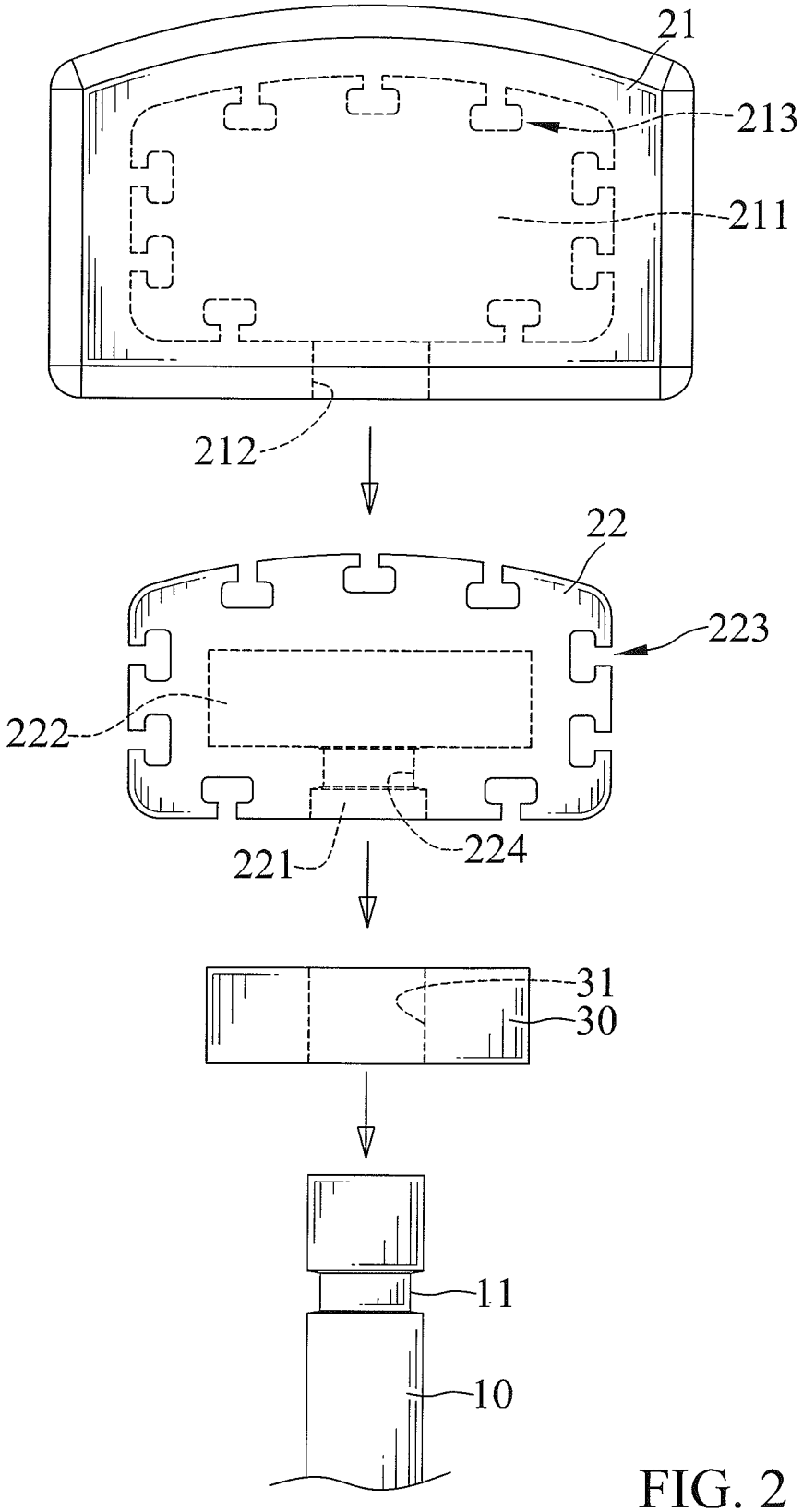
FIG. 2 is an exploded perspective view of the rubber mallet of the present invention.
Figure 3:
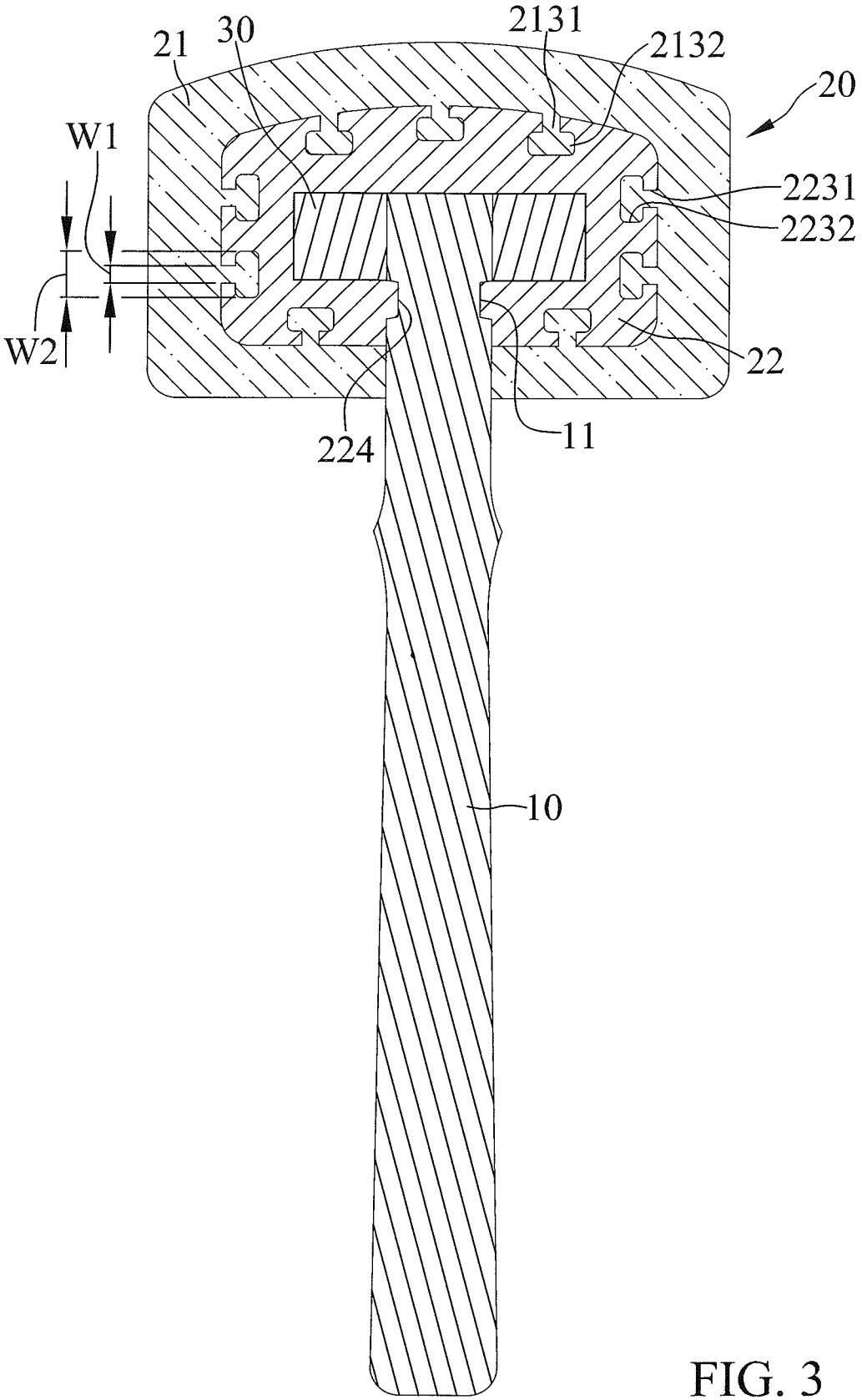
FIG. 3 is a cross-sectional view of the rubber mallet of the present invention.
Figure 4:
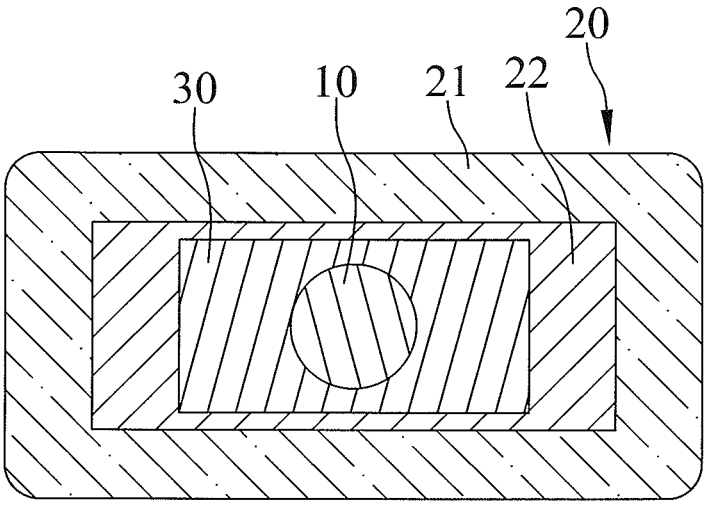
FIG. 4 is another cross-sectional view of the rubber mallet of the present invention.

FIGS. 1 through 4 show a rubber mallet of the present invention. The rubber mallet includes a handle 10 and a striking head 20. The striking head 20 includes an outer body 21 and an inner body 22 disposed within the outer body 21. The outer body 21 defines a receiving space 211 receiving the inner body 22. The receiving space 211 and the inner body 22 have corresponding shapes. The inner body 22 is of quadrilateral shape, but not limited thereto. Thus, the receiving space 211 is of quadrilateral shape. The outer body 21 includes at least one first coupling structure 213, and the inner body 22 includes at least one second coupling structure 223 mutually engaging with the at least one first coupling structure 213. One of the at least one first and second coupling structures 213 and 223 is a protrusion, and the other of the at least one first and second coupling structures 213 and 223 is a recess. The at least one first coupling structure 213 is located in the receiving space 211. The at least one first coupling structure 213 includes a first section 2131 and a second section 2132 extending radially out from the first section 2131. The at least one second coupling structure 223 includes a third section 2231 and a fourth section 2232 extending radially out from the third section 2231. The third and fourth sections 2231 and 2232 respectively engage with the first section 2131 and the second section 2132 of the at least one first coupling structure 213. The at least one first coupling structure 213 has a first width W1 and a second width W2 greater than the first width W1. The first and second widths W1 and W2 respectively define widths of the first and second sections 2131 and 2132 of the at least one first coupling structure 213. The third and fourth sections 2231 and 2232 of the at least one second coupling structure 223 respectively have widths corresponding to the first and second widths W1 and W2. As such, the inner body 22 is stably disposed in the receiving space 211.

The handle 10 is a wooden handle, but not limited thereto. The handle 10 inserts through a hole 212 defined by the outer body 21 and has a first end fixed to the inner body 22 and a second end protruding outside of the outer body 21 and disposed outside of the hole 212. The inner body 22 defines a first positioning space 221 and includes a protuberance 224 located in the first positioning space 221. The handle 10 includes a recess 11 engaged by the protuberance 224. Thus, the handle 10 and the striking head 20 are strongly coupled together. The inner body 22 also defines a second positioning space 222 in communication with the first positioning space 221. An inset balance 30 is disposed in the second positioning space 222. The inset balance 30 is metallic. The inset balance 30 defines a hole 31. The handle 10 inserts in the second positioning space 222 and engages with the hole 31 of the insert balance 30. The inset balance 30 has a hardness greater than a hardness of the inner body 22. The inset balance 30 not only enables a stronger connection between the handle 10 and the inner body 22, but also prevents the handle 10 from damaging the inner body 22.

Furthermore, the outer and inner bodies 21 and 22 are made of different materials. The outer body 21 includes constituent materials including styrene-ethylene-butylene-styrene and paraffin oil. The outer body 21 is rubbered. The inner body 22 includes recycled material as a constituent material. The inner body 22 includes constituent materials including styrene-ethylene-butylene-styrene, paraffin oil, polypropylene, calcium carbonate, and black organic pigment. In addition, the handle 10 and the striking head 20 are made of different materials.

Figure 5:
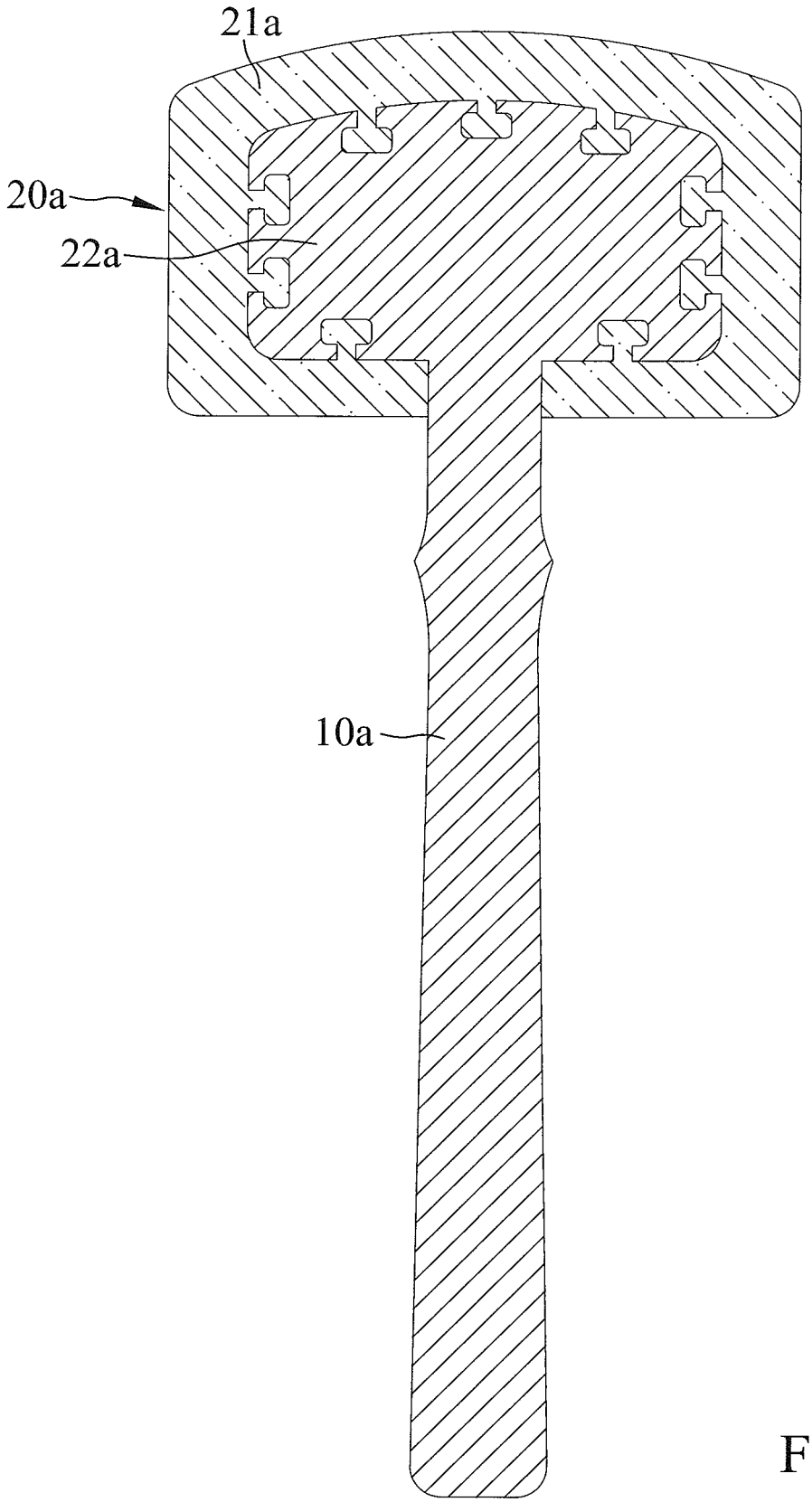
FIG. 5 is a cross-sectional view of a rubber mallet in accordance with a second embodiment of the present invention.

FIG. 5 is a cross-sectional view in accordance with a second embodiment of the present invention, and the same numbers are used to correlate similar components of the first embodiment, but bearing a letter a. The second embodiment differentiates from the first embodiment in that a handle 10*a* and inner body 22*a* of a striking head 20*a* are made in one piece. Thus, materials for the handle 10*a* and the striking head 20*a* are the same. The handle 10*a* has an end protruding out of an outer body 21*a* of the striking head 20*a*. The inner body 22*a* is received in the outer body 21*a*.

Figure 6:
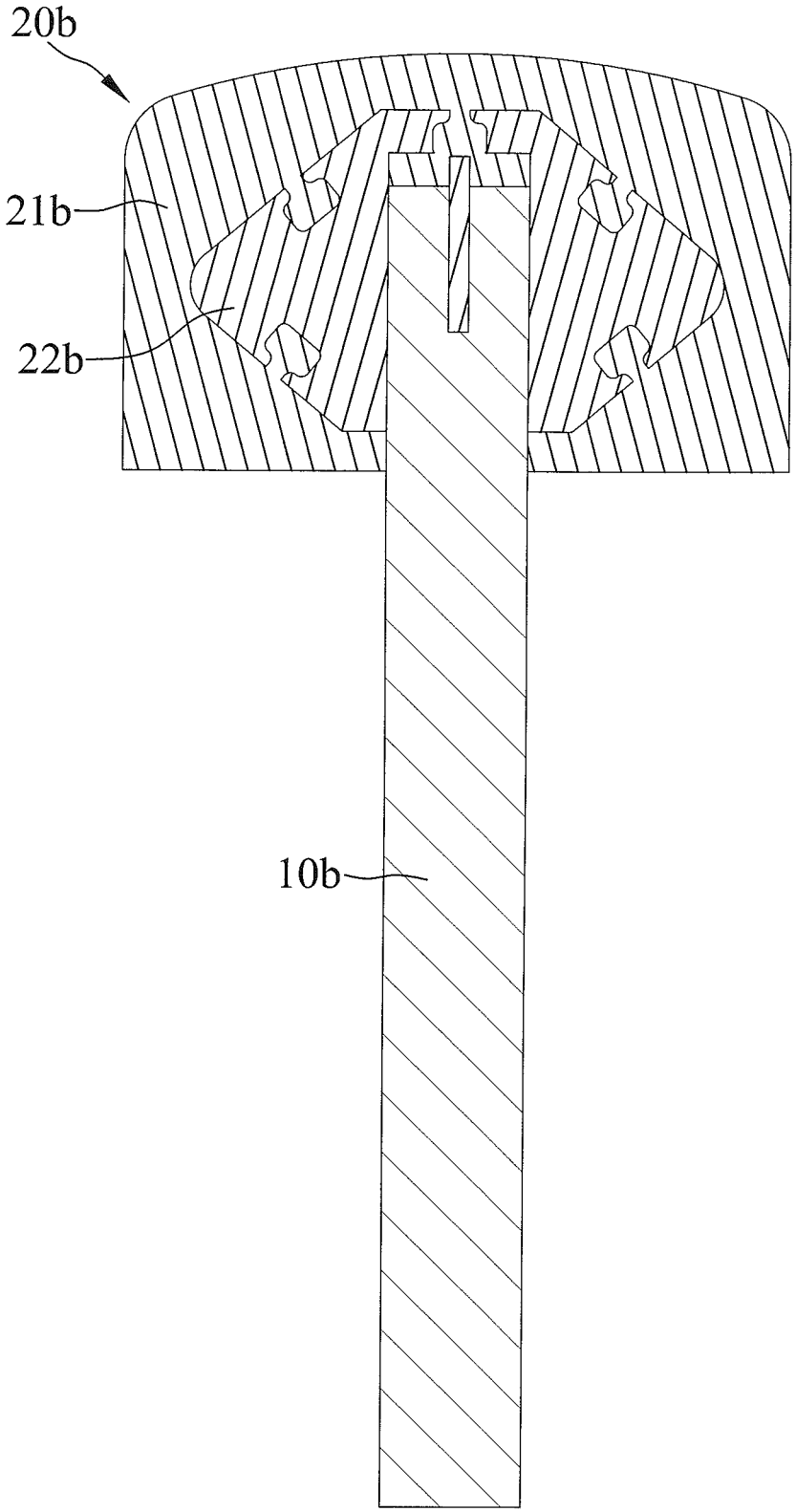
FIG. 6 is a cross-sectional view of a rubber mallet in accordance with a third embodiment of the present invention.

FIG. 6 is a cross-sectional view in accordance with a third embodiment of the present invention, and the same numbers are used to correlate similar components of the first embodiment, but bearing a letter b. The third embodiment differentiates from the first embodiment in that inner body 22*b* of the striking head 20*b* and receiving space of an outer body 21*b* are of corresponding polygonal shapes. The inner body 22*b* thus has an increased surface contact with the receiving space. The inner body 22*b*, in the embodiment, at least has six peripheral sides. Thus, the inner body 22*b* and the receiving space are hexagonal. The inner body 22*b* defines a hole, and the hole defines an opening on one of plurality of peripheral sides of the inner body. A handle 10*b* includes an end inserted in the inner body 22*b*.

In view of the forgoing, the rubber mallet is cheaper than conventional rubber mallets because low-cost recycled material constitute the inner bodies 22, 22*a*, and 22*b*. In addition, the inset balance 30 enables the rubber mallet to provide substantially more kinetic energy per strike. Therefore, a user can easily operate the rubber mallet to hit an object.

The foregoing is merely illustrative of the principles of this invention and various modifications can be made by those skilled in the art without departing from the scope and spirit of the invention.

What is claimed is:

1. A rubber mallet comprising:

a handle; and a striking head including an outer body and an inner body disposed within the outer body, wherein the outer body defines a receiving space receiving the inner body, wherein the outer body and the inner body each have a polygonal shape with a plurality of sides and are made of different materials, wherein the receiving space has a plurality sides corresponding to and surrounding the plurality sides of the inner body wherein the outer body defines a hole, and wherein the handle has a first end inserted through the hole of the outer body and fixed to the inner body and a second end protruding outside of the outer body and disposed outside of the hole;

wherein the inner body defines a first positioning space and a second positioning space in communication with the first positioning space, wherein an opening of the first positioning space extends through one side of the inner body, and wherein the first end of the handle fixed to the inner body is inserted in the second positioning space, wherein the outer body includes at least one first coupling structure and the inner body includes at least one second coupling structure mutually engaging with the at least one first coupling structure, wherein one of the at least one first and second coupling structures is a protrusion and the other of the at least one first and second coupling structures is a recess, and wherein the at least one first coupling structure is located in the receiving space and includes a first section and a second section extending radially out from the first section, wherein the at least one second coupling structure includes a third section and a fourth section respectively engaging with the first section and the second section of the at least one first coupling structure and includes the fourth section extending radially from the third section, wherein the at least one first coupling structure has a first width and a second width greater than the first width, and wherein the first and second widths are respectively defined at the first and second sections of the at least one first coupling structure.

2. The rubber mallet as claimed in claim 1, wherein the inner body includes recycled material as a constituent material.

3. The rubber mallet as claimed in claim 2, wherein the inner body includes constituent materials including styrene-ethylene-butylene-styrene, paraffin oil, polypropylene, calcium carbonate, and black organic pigment.

4. The rubber mallet as claimed in claim 3, wherein the outer body includes constituent materials including styrene-ethylene-butylene-styrene and paraffin oil.

5. The rubber mallet as claimed in claim 2, wherein the outer body includes constituent materials including styrene-ethylene-butylene-styrene and paraffin oil.

6. The rubber mallet as claimed in claim 1, wherein the handle and the inner body are made in one piece.

7. The rubber mallet as claimed in claim 1 further comprising an inset balance disposed in the second positioning space.

8. The rubber mallet as claimed in claim 7, wherein the inset balance defines a hole receiving the handle.

9. The rubber mallet as claimed in claim 7, wherein the inset balance is metallic.

10. The rubber mallet as claimed in claim 1, wherein the handle includes a recess and the inner body includes a protuberance located in the first positioning space engaging with the recess.

11. The rubber mallet as claimed in claim 1, wherein for the handle and the striking head are made of different materials.

12. The rubber mallet as claimed in claim 11, wherein the handle is a wooden handle.

13. The rubber mallet as claimed in claim 1, wherein the inner body and the receiving space are of quadrilateral shape.

14. The rubber mallet as claimed in claim 1, wherein the inner body and the receiving space are of polygonal shape.

* * * * *